US005743283A

United States Patent [19]

Horvath

[11] Patent Number: 5,743,283

[45] Date of Patent: Apr. 28, 1998

[54] SHIELDING DEVICE FOR PROTECTING RECREATION AREAS

[76] Inventor: John Horvath, 14016 Chestnut La., Orland Park, Ill. 60462

[21] Appl. No.: 766,670

[22] Filed: Dec. 13, 1996

Related U.S. Application Data

[63] Continuation-in-part of Ser. No. 551,531, Nov. 1, 1995, Pat. No. 5,636,649.

[51] Int. Cl.[6] ..... B60R 11/00; A45B 11/00; E04H 4/00

[52] U.S. Cl. ..... 135/16; 135/90; 135/96; 135/98; 135/15.1; 135/20.1; 4/496; 248/910

[58] Field of Search ..... 135/16, 98, 90, 135/96, 15.1, 20.1; 4/496; 248/910

[56] References Cited

U.S. PATENT DOCUMENTS

| | | |
|---|---|---|
| 332,917 | 12/1885 | Markham . |
| 560,245 | 5/1896 | Wagner . |
| 1,053,337 | 2/1913 | Williams . |
| 1,268,767 | 6/1918 | Peak . |
| 2,634,740 | 4/1953 | Duke . |
| 3,407,825 | 10/1968 | Doyle . |
| 3,486,514 | 12/1969 | Prescott . |
| 4,086,931 | 5/1978 | Hall . |
| 4,334,692 | 6/1982 | Lynch . |
| 4,759,545 | 7/1988 | Grable . |
| 4,927,117 | 5/1990 | Gainey . |
| 5,112,023 | 5/1992 | Sowers . |
| 5,205,308 | 4/1993 | Kendall . |
| 5,242,029 | 9/1993 | Marcella . |
| 5,390,685 | 2/1995 | McCoy . |

OTHER PUBLICATIONS

Preferred Living Catalog, pp. 58–59, 1995–1996 Ed.

*Primary Examiner*—Wynn E. Wood
*Attorney, Agent, or Firm*—Hill, Steadman & Simpson

[57] ABSTRACT

A cantilevered umbrella is supported from the apron of a pool by means of a base tube mounted in the apron, either horizontally just below the level of the deck formed by the apron, or vertically in the deck surface.

2 Claims, 3 Drawing Sheets

SHIELDING DEVICE FOR PROTECTING RECREATION AREAS

RELATED CASE

This application is a continuation-in-part of application Ser. No. 08/551,531, filed Nov. 1, 1995 now U.S. Pat. No. 5,636,649.

BACKGROUND OF THE INVENTION

1. Field of the Invention

This invention relates to a structural system for protecting recreational areas, such as a swimming pool, or a patio, or a children's sandbox. More particularly, this application adds to my earlier disclosure additional support means which can be integrated in an apron forming a deck surrounding the pool.

2. Description of the Prior Art

The art is represented by patio canopies and beach umbrellas which customarily provide a support column extending to the base of support at the center of the canopy or umbrella. There are available patio canopy constructions which embody the so-called European styling found in open-air cafes throughout Europe wherein a permanent base is located at a location offset from the point of utilization. In such European structures the canopy is cantilevered in the manner of a basket hoop on a backboard of a basket ball goal.

Somewhat similar cantilever support structures are also provided for water polo goals located at the ends of a swimming pool in which the game is played.

SUMMARY OF THE PRESENT INVENTION

The present invention contemplates the construction of a cantilevered holder for an umbrella or canopy which can be selectively mounted in spaced apart locales designed at different points in the apron forming a pool deck surrounding a pool.

DESCRIPTION OF THE PREFERRED EMBODIMENTS

Figure 1:
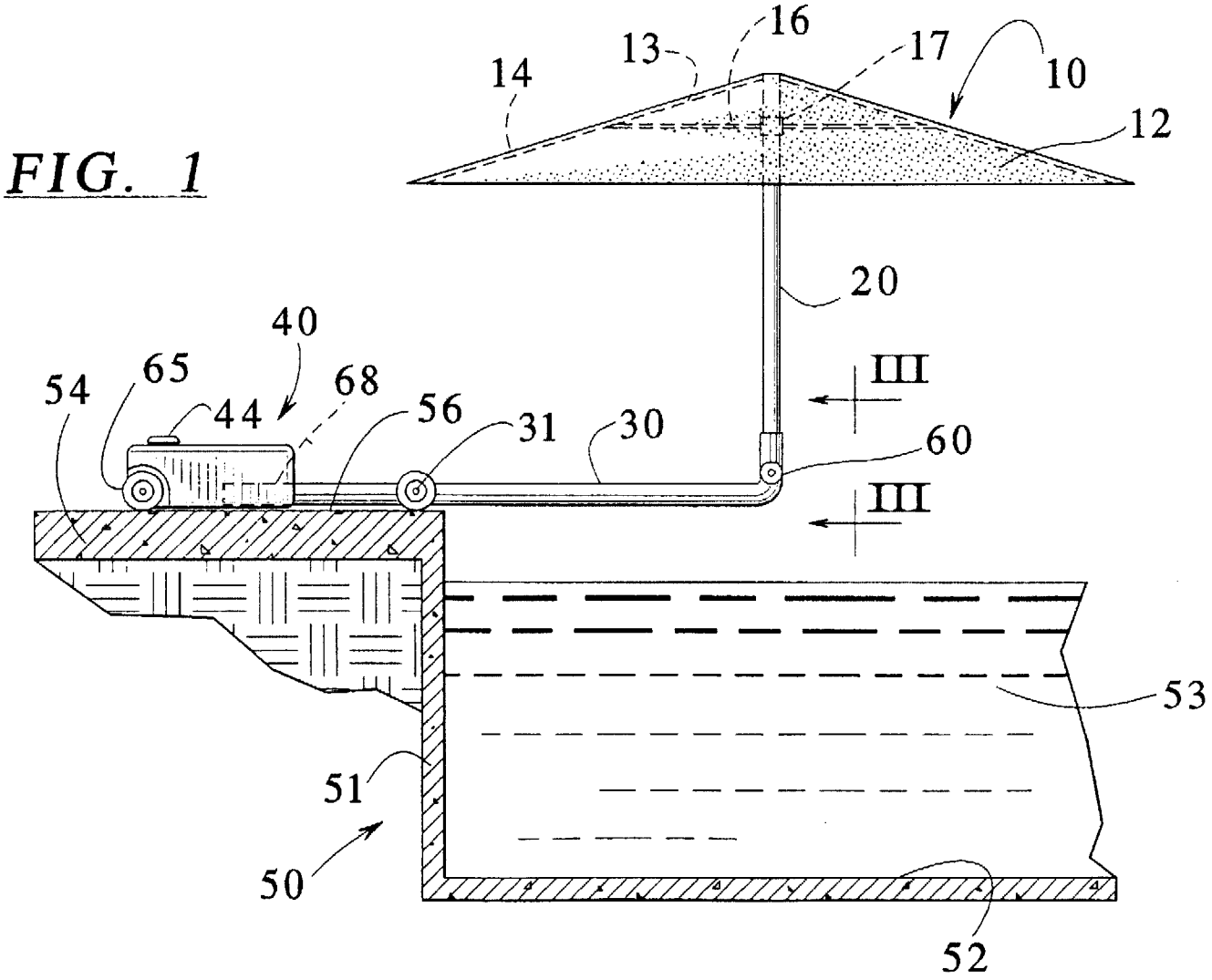
FIG. 1 is a side elevational view of one exemplar form of the present invention and showing an in-ground pool in fragmentary cross-section to illustrate how the shading device is employed in accordance with the principles of the present invention.

The present invention has special utility in any pool environment where it is desirable to shield a selected area over the water which is remote from an accessible deck location so that it would be desirable to provide a cantilevered support which is compatible with existing umbrellas and which can be handled safely and effectively by women and children and senior citizens.

The structure of the present invention consists essentially of only four separate main parts: (1) a canopy, or umbrella which will be identified at 10; (2) an umbrella pole which will be identified at 20; (3) a mounting bar which will be identified at 30; and (4) an anchoring means which will be identified at 40.

Referring to the drawings, it will be noted that the canopy or umbrella is shown at 10 and constitutes a retractable umbrella of the usual type provided for use on patios or on open- air esplanades and cafes. One of the advantages of the present invention is that it can be effectively utilized to retrofit most commercially available umbrellas for use in the special use environments contemplated.

The umbrella 10 may comprise a cover 12, which in the illustrative embodiment of this disclosure is generally square. However, it could be round, or circular. Further, it can be made of any desirable material suited to the purpose of shielding against the sun and/or rain. In some instances, the cover 12 may comprise a heavy opaque material which completely blocks the sun's rays, while in other instances, the cover 12 may constitute a relatively diaphanous material which is lacy in character and/or it may be relatively transparent, or translucent, such as a sheet-form plastic film.

In any event, the cover 12 is a fabric or a sheet-form material which is held on a collapsible frame 13 of a first set of thin ribs 14 radiating from the top of the umbrella pole 20. A second set of thin ribs 16 is connected at one end to a sliding ring 17 carried by the pole 11 and connected at the other end to an intermediate portion of a corresponding one of the first set of ribs 14.

In order to support the umbrella 10 in an upright position, there is provided the second part, namely, the umbrella support pole 20 which provides an upright vertical support column to which the umbrella 10 is adjustably connected. The pole 20 of the present invention is shown as comprising a hollow tubular cylinder made of metal and sized to cooperate with the ring 17. In most constructions, there will be provided a latch and detent means so that the ring 17 can be selectively positioned and locked at an uppermost position on the pole 20 when the umbrella is open or at a lowermost position on the pole 20 when the umbrella is closed.

In a conventional prior art usage, the umbrella pole 20 is inserted into a heavy base member which is usually counterweighted with sand or cement and which in many instances may be positioned underneath the midpoint of a table. The user can access the ring 17 and can raise or lower the umbrella at will.

In accordance with the principles of the present invention, however, it is contemplated that the umbrella or canopy 10 can be positioned over an inaccessible location, thereby to give protection and comfort to a user under circumstances where normal access would be difficult, if not impossible. For example, many persons of advanced years find that usage of a swimming pool offers the opportunity for excellent physical therapy as well as for comfort and enjoyment and relaxation. Such persons would like to avail themselves of these special benefits without undue exposure to the rays of the sun.

Figures 2, 4, 5:
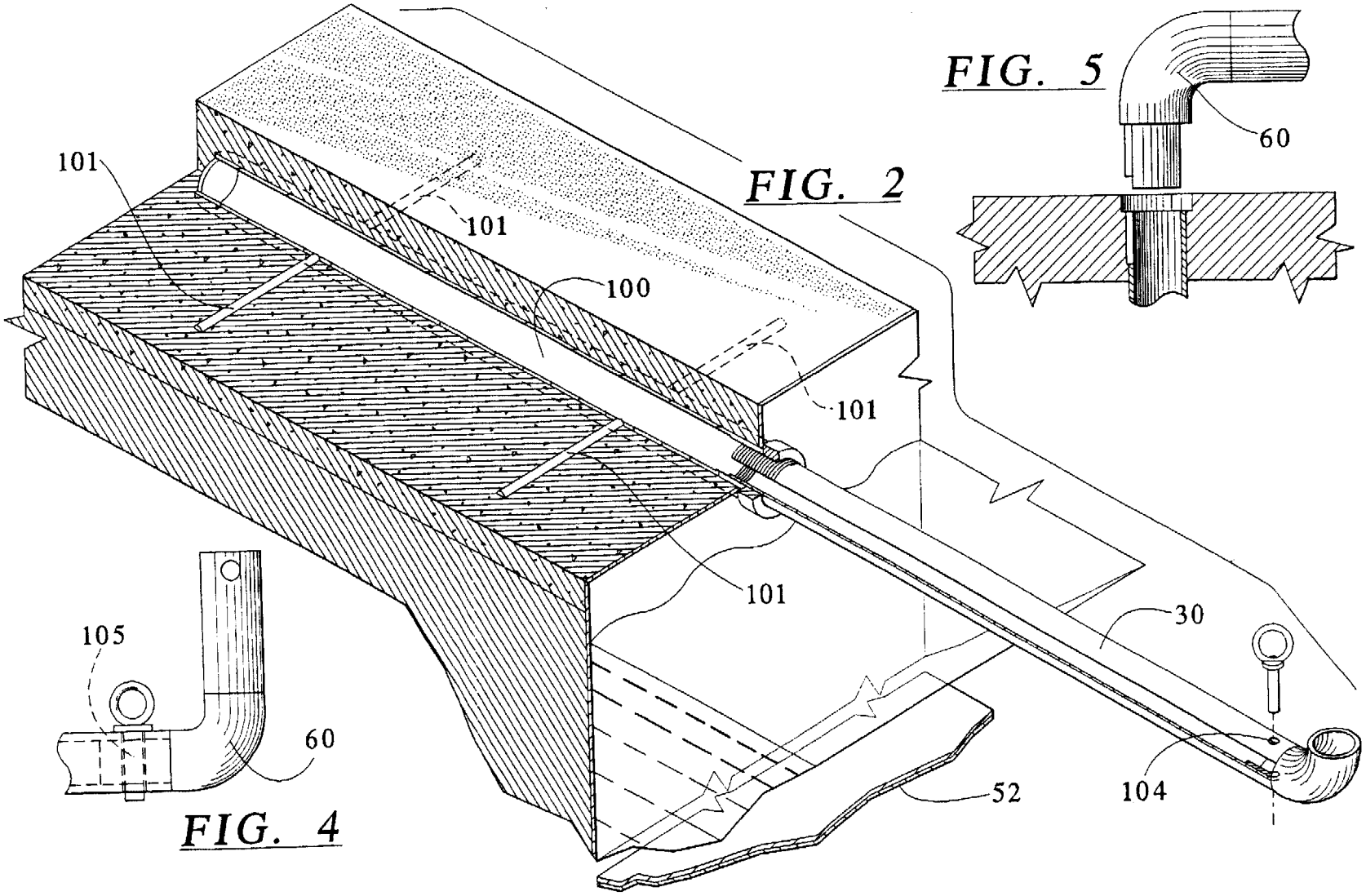
FIG. 2 is a cross-sectional view with parts shown in side elevation depicting one form of the present continuation-in-part invention.
FIG. 4 is an elevational view of a coupling member utilized in the present invention.
FIG. 5 is a fragmentary cross-sectional view showing yet another form of mounting and using a vertically disposed pipe sunk into the pool deck or apron.

Thus there is shown in FIGS. 1 and 2 an in-ground swimming pool 50 having the usual side walls 51 extending below grade level and a bottom wall 52 so that the pool can be filled with a supply of water shown at 53. The ground surface in which the pool 50 is sunken is surmounted by an apron forming a pool deck 54 at ground level extending around the edge of the pool. In FIG. 1, the apron or deck 54 comprises a concrete slab forming an extended pool deck 56 on which may be placed such pool side accessories such as deck chairs and possibly tables and/or lounge chairs.

The usual umbrella 10 is about five feet high if it is to protect two lounge chairs from the rays of the sun. Accordingly, to protect a remote area in the interior of the pool 50, i.e., an area which is inaccessible from the pool-side deck surface 56, the present invention contemplates the provision of a mounting bar 30.

The mounting bar 30 constitutes an elongated relatively thin member which may be of a tube or pipe and is designed to extend at deck level, i.e., at the level of the deck 56, or just below the level of the deck and to project from the apron 54 or deck 56 out over the water 53 in the pool 50. Such criterion is met by a metal cylindrical tube having at one end thereof a coupling joint 60, the structural details of which are illustrated in my earlier application.

The coupling joint 60 is a so-called swivel joint and in this disclosure the swivel joint has a ball and knuckle fitting which comprises a ball which is rotatably journalled on a shaft carried in a knuckle formed on, or connected to, the outermost end of the mounting bar 30. The ball has a male part sized and shaped to be telescopically mated with the end of the umbrella pole 20. Thus, by rotatably positioning the ball so that the umbrella pole 20 is at right angles to the mounting bar 30, the umbrella 10 will be positioned in upright position superjacent the pool 50 above the water 53. Thus, the mounting bar 30 extends away laterally from the reference axis or the pole 20 and the umbrella 10.

In accordance with this invention, the pool installer can provide one or more mounting bases at spaced points around the pool, for example on each side of the pool. By having a plurality of mounting bases the pool user can selectively pick out the area in which he desires shaded protection, depending on the time of day, or the depth of the water in the pool, or the particular activity in which the user wishes to engage.

Figure 3:
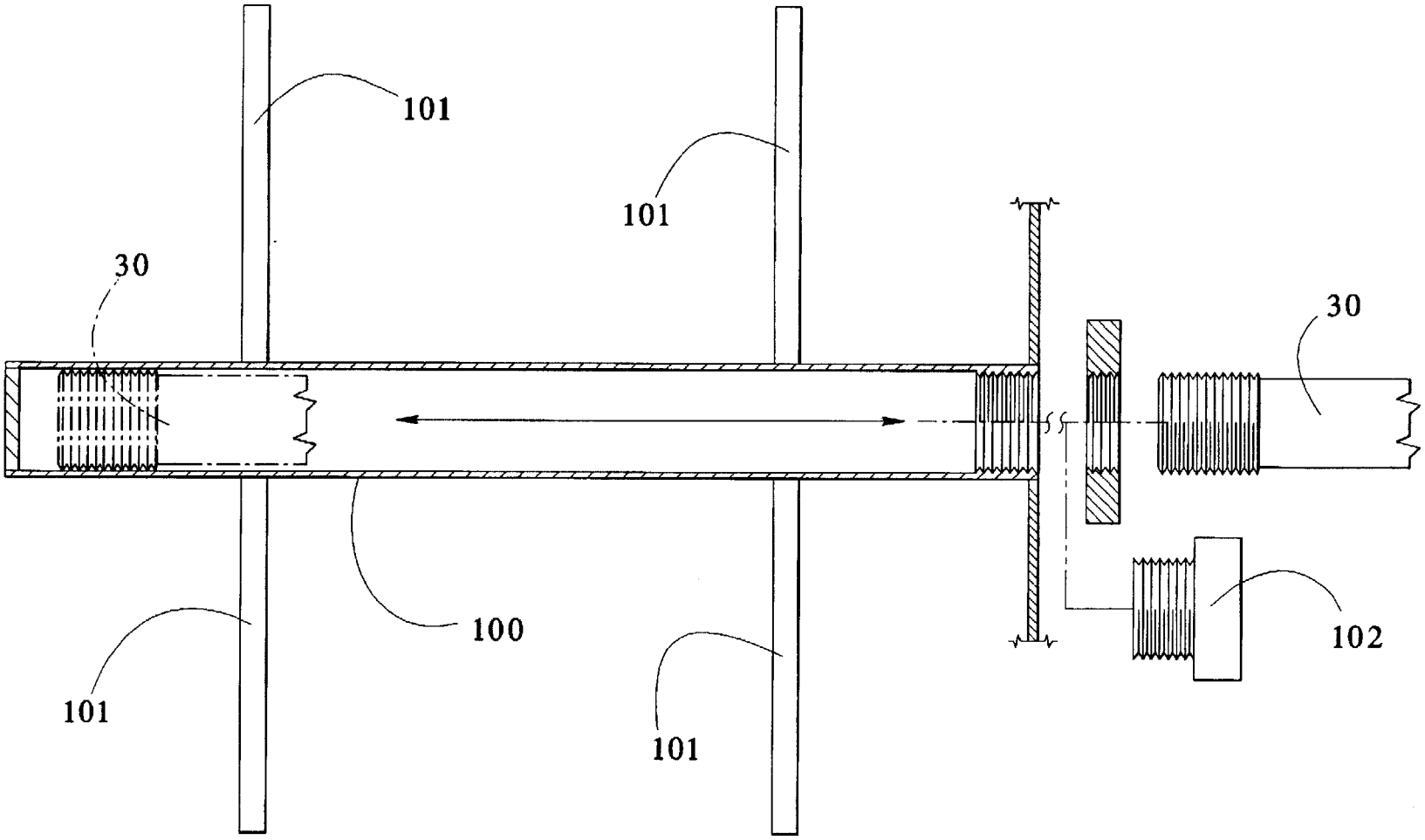
FIG. 3 is a fragmentary cross-sectional view taken in the direction of line III—III of FIG. 2.

Thus, as shown in FIG. 2 and FIG. 3, a horizontally disposed base tube 100 is provided which may be fitted with a plurality of transverse rebar supports 101 for greater stability. The tube 100 together with its supports 101 may be embedded in the wall of the pool apron 54 just below the level of the deck 56. The end of the tube 100 is threaded, or otherwise treated to receive, or accept, a sealing or closure cap 102 so the end opening of the tube 100 may be closed when not in use. The end opening of the tube 100 is disposed in flush alignment with the side wall 51 of the pool.

It will be understood that the tube 100 together with the rebar supports 101 may be integrated with the apron 54 by pouring the concrete of the apron right over the parts during the pool construction. However, in a deck 56 that is already formed, the tube 100 may be fitted into assembly with the apron 54 by forming an opening in the side wall of the apron or pool, for example, by drilling.

The actual number of base tubes utilized may be a matter of choice, depending on the user of the pool and the pool contractor.

The inside of the base tube 100 is hollow, i.e., it is formed with a cylindrical recess 103 into which the mounting bar 30 is sized to fit telescopically, thereby to establish a locking relationship with the base tube 100.

In the event the bar 30 takes the form of a pipe as shown in FIG. 2, the free end of the pipe may have a pin hole 104 through which a retaining pin 105 may be passed to lock the fitting 60 thereto.

In an alternative form of the invention, the deck 56 may be provided with one or more vertically disposed base tubes 200, each located in an opening in the deck surface 56 and extending down into, and/or through the apron 54 formed as part of the construction of the pool or retro-fitted into the existing deck of a pool. The base tube is counter sunk or threaded or otherwise adapted to receive a sealing or closure cap 202 when not in use.

A suitable coupling or fitting similar to the fitting 60 may be inserted into the opening 203 for coupling to the mounting bar 30. As in the form of the invention disclosed in FIG. 1 and claimed in my earlier application, the mounting bar then extends at deck level in the manner disclosed for the purposes set forth, namely, out over and above the surface of the water in the pool for support of an umbrella.

In an instance, the anchoring means of FIG. 2 and the anchoring means of FIG. 5 provide both vertical and horizontal resistance necessary to support the cantilevered umbrella in a stable support relationship with respect to the water in the pool.

Although minor modifications might be suggested by those versed in the art, it should be understood that I wish to embody within the scope of the patent warranted hereon all such modifications as reasonably and properly come within the scope of my contribution to the art.

I claim as my invention:

1. In combination with an in-ground swimming pool having side walls extending below grade level and a bottom wall and surrounded by an apron forming a deck at grade level, a cantilevered above-water pool umbrella assembly for protecting pool occupants while in the water, said assembly comprising:

an umbrella adapted to be selectively extended and retracted in a horizontal direction above grade and water level and extended to be disposed in a generally superjacent space parallel relationship above the level and surface of the water in the pool;

a vertical umbrella support pole projecting vertically upwardly above grade and water level to form an upright vertical support column carrying said umbrella;

a horizontally disposed mounting bar, a connecting joint between one end of said mounting bar and the lower end of said umbrella pole to vertically support the pole and the umbrella in an upright position above the level and surface of the water in the pool, and anchoring means connected to the other end of said mounting bar to anchor the umbrella to the apron of the pool and more particularly comprising;

a horizontally disposed base tube embedded in said apron below the surface of said deck and having transverse rebar means integrating said base tube with said apron and forming together therewith lateral displacement prevention means to firmly lock the umbrella support assembly against involuntary later displacement toward or away from the pool, said base tube having an opening in the pool side wall for selectively receiving said mounting bar in telescopic therewith for locking to the end of said mounting bar, coupling means between said base tube and said mounting bar and selectively interconnecting said other end of said mounting tube and said base tube for resisting lateral displacement forces, thereby to provide vertical support for the cantilevered umbrella on the vertical support column, and a closure cap for selectively closing said opening in said base tube when not in use.

2. In combination with a an in-ground swimming pool as defined in claim 1, a plurality of base tubes as defined in claim 1 spaced at intervals in the apron surrounding the pool, whereby an umbrella can be located at different selected locations in the pool.

* * * * *